US005906871A

United States Patent [19]

Takebe et al.

[11] Patent Number: 5,906,871

[45] **Date of Patent: *May 25, 1999**

[54] LATENT IMAGE, PREPARATION AND DEVELOPMENT THEREOF AND ARTICLES WITH THE IMAGE

[75] Inventors: Yasuo Takebe, Kyoto; Koichi Kugimiya, Osaka; Norihisa Mino, Nara; Tohru Nakagawa, Shiga, all of Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/645,773

[22] Filed: May 14, 1996

[30] Foreign Application Priority Data

May 15, 1995 [JP] Japan ..... 7-116160

[51] Int. Cl.[6] ..... B44F 1/02

[52] U.S. Cl. ..... 428/29; 428/199; 428/195; 428/212; 427/145

[58] Field of Search ..... 428/29, 199, 195, 428/212; 427/145

[56] References Cited

U.S. PATENT DOCUMENTS 4,613,515 9/1986 Reggio ..... 427/1
4,631,203 12/1986 Schaefer et al. ..... 427/145
4,882,195 11/1989 Butland ..... 427/1
5,278,126 1/1994 Katano et al. ..... 503/201

FOREIGN PATENT DOCUMENTS 1497791 1/1978 United Kingdom .

*Primary Examiner*—Marion McCamish
*Assistant Examiner*—Cheryl Juska
*Attorney, Agent, or Firm*—Merchant, Gould, Smith, Edell, Welter & Schmdit, P.A.

[57] ABSTRACT

A latent image comprising a first substance formed on a substrate of a second substance having a surface tension different from a surface tension of the first substance, the first substance and the substrate having a difference of 0.1 to 100 nm in height from each other. The latent image is formed by a method comprising the-step of subjecting a substrate of a first substance to a chemical treatment or a physical treatment to form a surface of a second substance which has a surface tension different from a surface tension of the first substance and has a difference of 0.1 to 100 nm in height from the substrate on part of the substrate. The latent image is developed by a method comprising the steps of contacting a latent image comprising a first substance formed on a substrate of a second substance having a surface tension different from a surface tension of the first substance with a third substance different from the first substance and the second substance, and applying a developing ray to the latent image.

17 Claims, 2 Drawing Sheets

LATENT IMAGE, PREPARATION AND DEVELOPMENT THEREOF AND ARTICLES WITH THE IMAGE

FIELD OF THE INVENTION

The invention relates to a latent image based on the difference in the distribution of surface tension between substances, methods of preparing and developing the image, and articles having the image.

BACKGROUND OF THE INVENTION

The term latent images refers to images that are not detectable to the naked eye and are visualized by development. Examples of the latent images include electrostatic images on a photoreceptor before toner is applied to the photoreceptor, latent images on a photographic film, and pictures drawn in invisible ink. The latent images are formed in several ways by using differences in the properties of the surface. Electrostatic images on a electronographic photoreceptor are formed due to differences in electrification. Latent images on a photographic film are formed by formation of a development center in a silver salt crystal. It is thought that similar latent images can be formed due to differences in surface tension.

However, the differences in surface tension were not used to form latent images because a film invisible to the naked eye which desirably generates difference in surface tension was not available. Further, a development procedure to permit detection of the difference in surface tension by the naked eye was not available.

Conventional latent images were deteriorated over time, or were not preserved well. Further, conventional latent images were not returned to the latent form once they were developed.

SUMMARY OF THE INVENTION

To solve the above-noted problems, the invention aims to provide latent images free of deterioration over time that will be preserved well, and that can shuttle between visible and latent forms. The invention also aims to provide a method of readily visualizing such images, and articles having the latent images.

To attain the object, the invention provides a latent image comprising a first substance formed on a substrate of a second substance. The second substance has a surface tension different from a surface tension of the first substance. The first substance and the substrate have a difference of 0.1 to 100 nm in height from each other. The first substance can be formed by partly shaving off the surface of a substrate or partly denaturing the surface of a substrate. Also, the first substance can form a film on the substrate. In other words, a chemical or physical treatment to a substrate newly forms a site of a substance different from the substrate on the substrate. The site is different from the substrate in surface tension. The difference in surface tension is used to form latent images in the invention.

It is preferable in the latent image that the first substance forms a film having a thickness of 0.1 to 100 nm on the substrate.

It is preferable in the latent image that the substrate is formed of at least one material selected from the group consisting of metal, glass, plastic, rock, ceramic and mineral.

It is preferable in the latent image that the substrate has a transparent or mirror surface.

It is preferable in the latent image that the film is a chemically adsorbed film covalently bonded to a surface of the substrate via a covalent bond.

It is preferable in the latent image that the first substance is a silane compound bonded to a surface of the substrate via siloxane bonds (Si—O).

It is preferable in the latent image that the first substance is a thiol compound.

It is preferable in the latent image that the first substance is a compound having at least one group selected from the group consisting of alkyl groups and fluoroalkyl groups.

It is preferable in the latent image that the first substance is an alkylpolysiloxane represented by Formula I Formula I

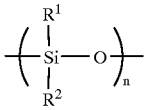

wherein $R^1$ is an alkyl group having 1 to 7 carbon atoms, $R^2$ is a hydrogen atom, an alkyl group having 1 to 7 carbon atoms or an aryl group having 6 carbon atoms, and n is an integer from 5 to 900.

In Formula I, $R^1$ and $R^2$ can be either the same or different from each other. $R^1$ and $R^2$ can be an alkyl or fluoroalkyl group. The alkyl or fluoroalkyl group can be either a straight-chain or branched-chain group.

The invention also provides a method of forming a latent image comprising the step of subjecting a substrate of a first substance to a chemical treatment or a physical treatment to form a surface of a second substance which has a surface tension different from a surface tension of the first substance, and has a difference of 0.1 to 100 nm in height from the substrate, on part of the substrate. The surface of the second substance can be formed by partly shaving off the surface of the substrate or partly denaturing the surface of the substrate. Also, the second substance here can form a film on the substrate of the first substance.

It is preferable in the method of forming a latent image that the substrate is contacted with the second substance to form a film of the second substance having a thickness of 0.1 to 100 nm on the substrate.

It is preferable in the method of forming a latent image that the substrate is contacted with a silane compound comprising a silicon atom and at least one group selected from the group consisting of alkoxy groups, isocyanate group, acetoxy group and halogen. The above selected group is preferably bonded to the silicon atom in the silane compound. According to the above-noted configuration, when the silane compound contacts with the substrate, the silane compound reacts with the substrate so that Si—O bonds are formed between the silane compound and the substrate. Consequently, any of alkoxy groups, isocyanate group, acetoxy group and halogen is eliminated from the silane compound to form a film derived from the silane compound, that is, a film of the second substance.

It is preferable that the method of forming a latent image further comprises the steps of covering part of the substrate with a third substance, contacting the substrate and the third substance with the second substance to form a film of the second substance on a surface of the substrate that is free of the third substance, and removing the third substance from the substrate. The third substance refers to a substance capable of adhering to the surface of the substrate in the form of drop or solid.

It is preferable that the method of forming a latent image further comprises the steps of covering part of the substrate with a third substance, subjecting the substrate and the third substance to a chemical or physical treatment to form a surface of the second substance on a surface of the substrate that is free of the third substance, and removing the third substance from the substrate.

It is preferable that the method of forming a latent image further comprises the steps of covering part of the substrate with a third substance, contacting the substrate and the third substance with a silane compound comprising a silicon atom and at least one group selected from the group consisting of alkoxy groups, isocyanate group and acetoxy group and halogen and bonded to the silicon atom to form a film of the second substance on a surface of the substrate that is free of the third substance, and removing the third substance from the substrate.

It is preferable in the method of forming a latent image that the chemical treatment is a treatment in which the substrate is contacted with at least one selected from the group consisting of alkaline solution, hydrofluoric acid, Grignard's reagents and trichlorosilane derivatives.

It is preferable in the method of forming a latent image that the physical treatment is a treatment in which the substrate is subjected to at least one selected from the group consisting of ultraviolet irradiation, oxygen plasma irradiation, vapor plasma irradiation and electron beam irradiation.

The invention further provides a method of developing a latent image comprising the steps of contacting a latent image comprising a first substance formed on a substrate of a second substance having a surface tension different from a surface tension of the first substance with a third substance different from the first substance and the second substance, and applying a developing ray to the latent image. The third substance refers to a substance capable of adhering to the surface of the latent image in the form of a drop or solid. The term developing ray here refers to a ray having a function of revealing the latent images.

It is preferable in the method of developing a latent image that the third substance is in the form of vapor. Examples of the vapor include vapor of organic solvents such as ethyleneglycol, vapor derived from solids such as iodine, and preferably saturated steam.

It is preferable in the method of developing a latent image that the developing ray is at least one selected from the group consisting of visible ray, infrared ray, ultraviolet ray, electron beam and laser beam.

The invention further provides an article having a latent image comprising a first substance formed on a substrate of a second substance having a surface tension different from a surface tension of the first substance, the first substance and the substrate having a difference of 0.1 to 100 nm in height from each other. The substrate can either be the article itself or different from the article.

It is preferable in the article that the first substance forms a film having a thickness of 0.1 to 100 nm on the substrate.

It is preferable in the article that the substrate is formed of at least one material selected from the group consisting of metal, glass, plastic, rock, ceramic and mineral.

It is preferable in the article that the article is a plastic product partly coated with metal.

It is preferable in the article that the article is a card.

It is preferable in the article that the article is one selected from the group consisting of a credit card, an identification card, a license, a certificate, a membership card and a cash card.

It is preferable in the article that the article is one selected from the group consisting of a metallic container, a glass container, a ceramic container and a porcelain container.

DETAILED DESCRIPTION OF THE PREFERRED EMBODIMENTS

Figure 1:
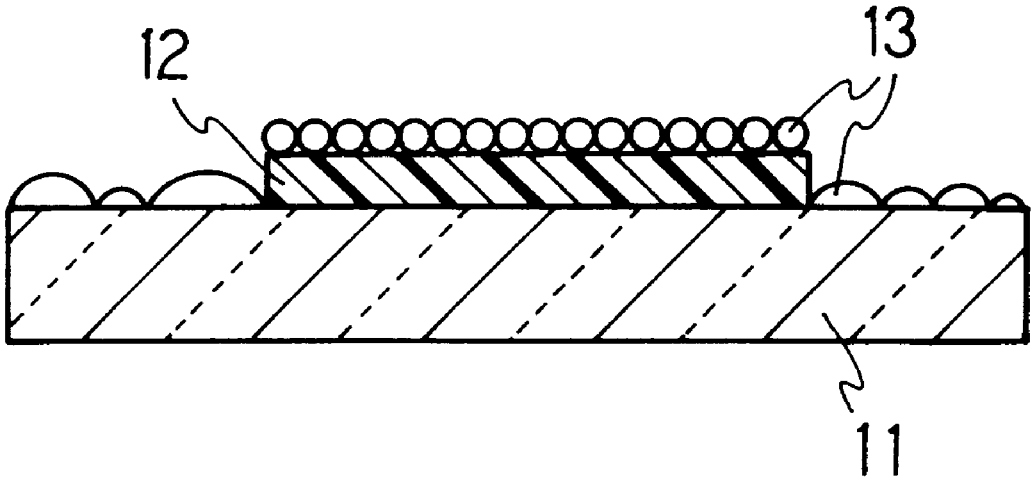
FIG. 1 is a sectional view of a latent image in an embodiment of the invention.
Figure 2A:
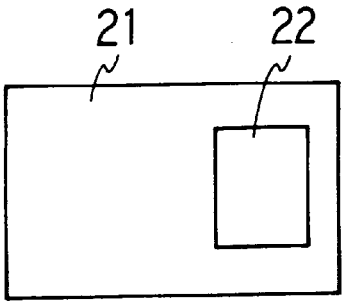
FIGS. 2(*a*) through 2(*d*) show a latent image in an embodiment of the invention.
Figure 2B:
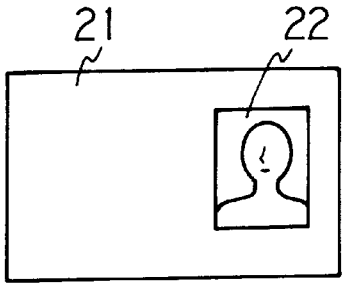
Figure 2C:
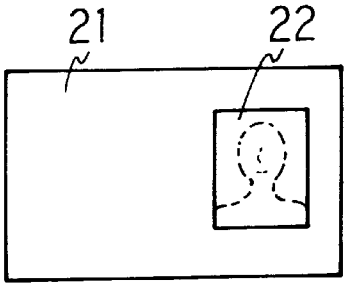
Figure 2D:
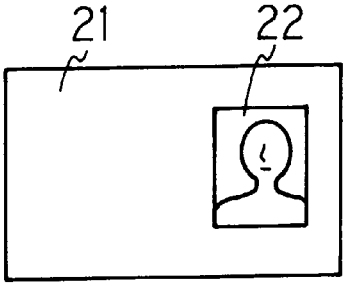

The surface tension of substances is dependent on the substances and the surface tension of a substance can be changed by a chemical or physical treatment. The difference in surface tension between substances results in latent images. Examples of a chemical treatment include treatment using alkaline solution, hydrofluoric acid, Grignard's reagents or trichlorosilane derivatives. Examples of a physical treatment include ultraviolet irradiation, oxygen plasma irradiation, steam plasma irradiation and electron beam irradiation.

The invention provides a latent image formed by using the difference in surface tension inherent in each substance. The latent images are not deteriorated over time or by irradiation with developing rays, and the images are preserved indefinitely. Further, the latent images are easy to form. When the difference in height between substrate and latent images formed thereon is less than 25% of the wavelength of developing ray, the developing ray is free of optical interference at an interface between the substrate and the latent images formed thereon. Then, the interface is not detected by the developing ray and remains latent. When a surface newly formed as latent images on the substrate is detected by the developing ray before a third substance contacts with the surface, the surface does not serve as latent images. Therefore, the difference in height between the substrate and surface newly formed thereon should be less than 25% of wavelength of the developing ray. The limitations of the difference in height depend on the developing rays. When visible light having a wavelength of 400 nm or less is used, a difference of 100 nm or less in height is sufficient. The lower limit of the difference in height should be at least a thickness of a monomolecular film so as to generate a difference in surface tension between substrate and surface newly formed thereon. A monomolecular film having a sufficient density can form a desired surface on the substrate and generate a desired difference in surface tension. Then, a desired difference in height is, for example, 1 to 4 nm.

Any solid substances are suitable for use as a substrate on which a latent image is formed, as long as the substrate is properly irradiated with a developing ray and the latent image is detected sufficiently. A substrate preferably has a mirror surface to detect differences in reflectance of the developing ray. To detect differences in transmittance of the developing ray, a substrate preferably has a transparent surface. When a substrate is formed of at least one material selected from the group consisting of metal, glass, plastic, rock, ceramic and mineral, latent images are formed on a variety of substances on which no latent images were formed before. Examples of metal material for the substrate include gold, silver, copper, iron, aluminum, nickel, chromium, tin, zinc, lead, titanium, and alloys thereof such as stainless steel, brass, bronze, solder or duralumin. Examples of glass material for the substrate include silicate glass, phosphosilicate glass, borosilicate glass, quartz glass, soda-lime glass, lead glass or barium glass. Examples of plastic material for the substrate include polyethylene, polypropylene, polystyrene, polycarbonate, poly(methyl methacrylate), poly(hydroxy ethyl methacrylate), acrylic resins, polyether sulfone, poly(vinyl chloride), poly (vinylidene chloride), rayon, cellulose resins, nylons, fluorine resins, silicon resins, and copolymer thereof such as acrylonitrile-butadiene-styrene (ABS) resin or acrylonitrile-styrene (AS) resin. Examples of rock for the substrate include marble, granite and agate. Examples of ceramic material for the substrate include porcelain, china, artificial stone, imitation jewelry, aluminum nitride, silicon nitride, titanium nitride, alumina, tungsten carbide and silicon carbide. Examples of mineral for the substrate include diamond, ruby, sapphire, emerald, topaz and quartz.

The substrates can have a flat surface or an uneven surface. The latent images of the invention can be formed on a curved surface such as the surface of a wineglass, or a rough surface such as that of frosted glass. When a substrate has a transparent or mirror surface, differences in transmissivity with respect to the developing ray are readily detected between the substrate and a third substance for visualizing latent images, and the images are readily visualized.

The surface tension of the substrate can be larger than the surface tension of a surface newly formed thereon, and vice versa. Substrates such as those of metal, glass, rock, ceramic or mineral, have a relatively large surface tension. The lower the surface tension of the surface newly formed on such a substrate, the clearer the latent images are displayed. Examples of the suitable surface having a small surface tension include a surface derived from silane compounds having an alkyl or fluoroalkyl group, thiol compounds and alkylpolysiloxane.

Substrates such as those of plastic have a relatively low surface tension. The higher the surface tension of the surface newly formed on such a substrate, the clearer latent images are displayed. Examples of the surface formed on the substrate include a surface derived from silicon oxide and plastic having polar groups exposed due to plasma treatment.

When a film for a latent image on a substrate is a chemically adsorbed film bonded to the substrate via covalent bonds, the resulting latent image is superior in endurance, because the film is firmly bonded to the substrate. When the surface newly formed on the substrate is derived from a silane compound, siloxane bonds (Si—O) are formed between the silane compound and hydroxyl groups on the substrate such as that of glass or metal oxide. In another case, silane compounds can form covalent bonds with amino groups on a substrate.

When the surface newly formed on the substrate is derived from a thiol compound, a sulfur atom in the thiol compound forms covalent bonds, with a metal substrate such as Ag or Au. When the surface newly formed on the substrate is derived from a silane or thiol compound having an alkyl or fluoroalkyl group, the surface tension of a portion in the substrate covered with the other substance is reduced, generating sufficient difference in surface tension between the substrate and the portion. Examples of the silane compound having an alkyl or fluoroalkyl group include a compound represented by Formula II.

Formula II

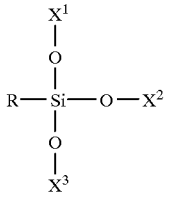

wherein R represents an alkyl group or a fluoroalkyl group, and $X^1$, $X^2$ and $X^3$ represent substrate or a silicon atom of another molecule adjacent to the molecule of the compound represented by Formula II. The above compound has an alkyl or fluoroalkyl group, and bonds to the substrate or another silane compound via Si—O bonds. The alkyl group preferably has 1 to 30 carbon atoms. The fluoroalkyl group preferably has 3 to 12 carbon atoms. The surface tension of the surface newly formed on the substrate is more reduced with increasing carbon atoms in the alkyl or fluoroalkyl group. Further, a fluoroalkyl group is more effective for reducing the surface tension than an alkyl group. Examples of the silane compound include compounds represented by Formulas III (a) through III (f).

Formula III(a)

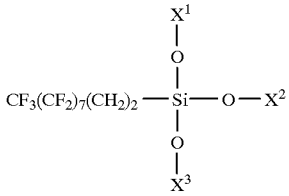

Formula III(b)

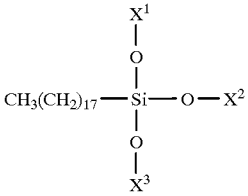

Formula III(c)

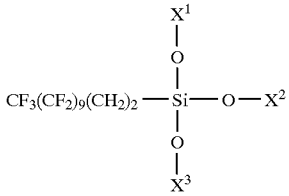

Formula III(d)

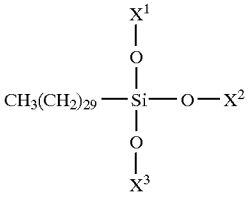

-continued

Formula III(e)

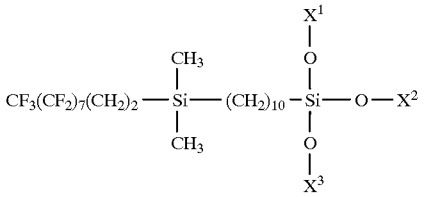

wherein $X^1$, $X^2$ and $X^3$ represent substrate or a silicon atom of another molecule of the compound adjacent to the molecule of the compound represented by each formula.

Formula III(f)

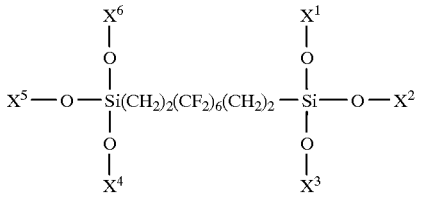

wherein $X^1$ through $X^6$ represent substrate or a silicon atom of another molecule of the compound adjacent to the molecule of the compound represented by each formula.

When the substance for latent images is an alkylpolysiloxane represented by Formula I, the latent image can be formed in a coating. In Formula I, $R^1$ is an alkyl group having 1 to 7 carbon atoms, $R^2$ is a hydrogen atom, an alkyl group having 1 to 7 carbon atoms, $R^2$ is an aryl group having 6 carbon atoms, and n is an integer from 5 to 900. The surface tension of the alkylpolysiloxane is more reduced with increasing carbon atoms for $R^1$ or $R^2$ in Formula I . However, polydimethylsiloxane where both $R^1$ and $R^2$ are a methyl group ($CH_3$—) is economically preferred because it is the least expensive. The endurance of latent images is more improved with increasing n in Formula I . However, when n is too big, the substance is difficult to dissolve in a solvent, and the substance has too much viscosity. Although a preferable value depends on a combination of $R^1$ and $R^2$, the preferred number of n is around 200.

The method of forming latent images of the invention enables the formation of latent images of the invention effectively.

The silane compounds preferably have an alkoxy group having 1 to 3 carbon atoms. Specifically, a methoxy ($CH_3O$—), ethoxy ($CH_3CH_2O$—) or propoxy ($CH_3CH_2CH_2O$—) group is preferable. Preferred halogen includes chlorine and bromine.

Films formed of the above silane compound have the same chemical structure, independently of the kind of functional groups in the silane compound. The functional groups here refer to any of an alkoxy group, an acetoxy group, an isocyanate group and halogen. When the silane compound contacts with the substrate, hydroxyl or amino groups in the substrate react with the silane compound. The functional group is eliminated as a bond of Si—O or Si—N is formed between the substrate and the silicon atom, and the silane compound not containing the functional group forms a film on the substrate.

Although films formed of the silane compound have the same chemical structure, independently of the kind of functional groups in the silane compound, the reaction rate for forming a film is significantly different between functional groups. In general, silane compounds having halogen react most rapidly, and silane compounds having an alkoxy group react most slowly. Among halogens, chlorine and bromine exhibit similar reactivity. Among the alkoxy groups, the methoxy group, ethoxy group and propoxy group have similar reactivity.

The silane compounds are selected with respect to the conditions under which latent images are formed. The silane compounds having halogen are useful to form a latent image in a short time, and the forming reaction is completed at room temperature within 5 min. However, such compounds having high reactivity should be treated in dry atmosphere. When a silane compound having an alkoxy group is used, the forming reaction is usually completed at 100° C. for about 1h.

In the invention, a surface for latent images is formed on part of a substrate in two ways, the masking method and the direct method.

In the masking method, a substrate is masked with another substance, a spot or film is formed of a third substance on an unmasked portion of the substrate, and then the masking substance is removed. Examples of the masking substance include printing ink, photoresist film and plastic film having a hole.

In the direct method, part of a substrate is exposed to another substance or subjected to a chemical or physical treatment to form another surface on the substrate. For example, silane compounds are printed in a pattern by screen printing, or an intended portion is merely irradiated with scanning electron beam, or a substrate covered with a photomask is irradiated with ultraviolet rays. An appropriate method is selected dependently on the size or shape of a substrate, a required resolution, properties of substances for latent images and substrates and the like.

The method of developing a latent image using the difference in surface tension readily visualizes a latent images for the naked eye. Any substance in the form of drop or solid adhering to the surface of the latent image can be the third substance for developing the images. Steam preferably covers a rough surface thoroughly. Liquid having a low viscosity of 13.5 centipoise or less, such as ethylene glycol, can be suitable. When the third substance is saturated water vapor, the latent image of the invention is displayed readily and safely without using particular materials.

The third substance adheres to a surface in different ways depending on the surface tension of the surfaces. The result is, for example, that the amount of adsorption for the third substance is different between surfaces, the contact angle of the drop is different between surfaces or the particle diameter of precipitated solid is different between surfaces. Then, irradiation of appropriate developing ray visualizes the third substance enough to display the latent images. Examples of the developing ray include visible light, infrared ray, ultraviolet ray, electron beam and laser beam. Under usual brightness such as 20 lux or more, the visualized third substance can be detected by the naked eye without using a particular developing ray.

The article of the invention has a latent image which is readily developed as required. The latent image can show the manufacturer or brand, or can certify a genuine product in an inconspicuous way without displeasing customers or deteriorating the artistic value of the article. Examples of metal substrates include tableware, mirror, cookware and art objects. Examples of glass substrates include tableware, mirror, art objects, containers and windowpane. Examples of plastic substrates include cards, containers and organic glass for windowpane. Examples of rock substrates include marble wall, desk, gravestone, monuments, seals, accessories and ornaments. Examples of ceramic substrates include tableware, containers, sanitary ware, art objects and artificial stone. Examples of mineral substrates include jewelry, accessories and ornaments.

When the substrate is a plastic product which is partly covered with metal, the latent image is formed on the metal site so that cards like identity cards are efficiently provided.

When the article is in the form of a card, cards like identity cards are rationally provided. When latent images indicating identification numbers, card numbers, marks, or identification photographs are formed on such cards, the cards work without displeasing users.

When the article is any of metal containers, glass containers, porcelain containers and ceramic containers, the latent image can indicate the manufacturer or brand, letters or marks indicating users or stores as required without displeasing customers in a conspicuous way or deteriorating the appearance of the article.

The invention is explained with reference to the accompanying drawings. It should not be understood that the invention is limited to the embodiments of the drawings or the following examples.

EXAMPLE 1

A glass plate (10 cm×10 cm×1 mm in thickness) was washed in a conventional manner, and a pattern was formed with ink on the glass by screen printing. The glass was soaked in a solution of 1 wt. % heptadecafluorodecyltrichlorosilane ($CF_3(CF_2)_7$ $(CH_2)_2SiCl_3$) in hexadecane at room temperature for 1h, with the ink pattern acting as a mask. A thin film containing a fluoroalkyl group in a thickness of about 2.3 nm was formed on a portion of the glass free of the ink. Then, the glass was washed with acetone to remove the ink.

The thickness of the thin film was much smaller than the wavelength of the ultraviolet ray or the visible ray. Therefore, the thin film was not detected by irradiation of the ultraviolet ray or the visible ray, and the thin film formed a latent image. The transparency of the glass was not influenced by the thin film. The surface tension of the thin film was 18 dyn/cm, and the surface tension of the glass free of the film was about 65 dyn/cm.

The latent image was exposed to saturated steam, and the steam was cooled to liquefy. FIG. 1 shows that drops 13 adhered to thin film 12 and glass substrate 11. The drop was about 0.1 nm in diameter. The contact angle of drop to glass was 110° on the film and about 20° on the glass substrate. When the substrate was irradiated with visible light as a developing ray, the latent image was developed by detecting transmitted light or scattered light. In other words, the contact angle of drop was significantly different between the film and the glass, and scattering of the light was different accordingly. In this method, a line having a width of 0.3 mm was recognized by the naked eye.

Similar to heptadecafluorodecyltrichlorosilane, octadecyltrichlorosilane ($C_{18}H_{37}SiCl_3$) or polydimethylsiloxane was effective to form similar latent images. Similar latent images are formed on other substrates such as aluminum, stainless steel, aluminum ceramics or sapphire.

EXAMPLE 2

A glass plate (10 cm×10 cm×1 mm in thickness) was washed in the manner as in Example 1. A treatment solution containing 1 wt. % heptadecafluorodecyltrichlorosilane in fluid paraffin was printed on the glass by screen printing. The glass was allowed to stand at room temperature for 1h. The glass was then washed with hexane to remove a surplus solution, thereby forming a thin film having a fluoroalkyl group on the glass. The film was about 4 nm in thickness, and it was sufficiently thinner than the wavelength of ultraviolet ray and visible ray so that the film was not detected by such rays and the film formed a latent image. The surface tension of the thin film was 22 dyn/cm, and the surface tension of the glass free of the film was about 65 dyn/cm.

The latent image was exposed to saturated steam, and drops having a diameter of about 0.1 nm adhered to the image. The contact angle of drop to glass was 105° on the film and about 20° on the glass substrate. When the substrate was irradiated with visible light as a developing ray in the same manner as in Example 1, the latent image was visualized. In this method, a line having a width of 0.3 mm was recognized by the naked eye.

Similar latent images were formed by using polydimethylsiloxane instead of heptadecafluorodecyltrichlorosilane.

EXAMPLE 3

A glass plate (10 cm×10 cm×1 mm in thickness) was washed in the manner as in Example 1. A 2.3 nm thick film containing a fluoroalkyl group was formed on the whole surface of the glass by soaking a solution of 1 wt. % heptadecafluorodecyltrichlorosilane ($CF_3(CF_2)_7(CH_2)_2SiCl_3$) in hexadecane at room temperature for 1h. The same pattern as in Example 1 was formed on the thin film by screen printing with ink. The film with the pattern as a mask was soaked in a solution of 10% sodium hydroxide at room temperature for 1h and then washed with water. Part of the thin film, free of the patterned ink, was eluted. The substrate was washed with acetone to remove the ink. The obtained glass substrate had a film formed thereon in the area on which a film was not formed in Example 1, and a film was not formed in the area on which the thin film was formed in Example 1. The surface tension of the thin film to which the ink had adhered was 18 dyn/cm, and the surface tension of the glass free of the film and the ink was about 65 dyn/cm.

The latent image was exposed to saturated steam, and drops having a diameter of about 0.1 mm adhered to the image. The contact glass substrate. When the substrate was irradiated with visible light as a developing ray in the same manner as in Example 1, the latent image was visualized. The obtained image was reverse to that of Example 1. In this method, a line having a width of 0.3 mm was recognized by the naked eye.

EXAMPLE 4

Gold was deposited on a glass plate (10 cm×10 cm×1 mm in thickness), and a pattern was formed with ink on the deposited gold in the same manner as in Example 1. The gold deposited glass was soaked in a solution of 1 wt. % octadecylmercaptan ($C_{18}H_{37}SH$) in chloroform at room temperature for 1h, provided that the patterned ink was a mask. A thin film containing an alkyl group in a thickness of about 2 nm was formed on a portion of the gold film free of the ink. Then, the glass was washed with acetone to remove the ink.

The thickness of the thin film was much smaller than the wavelength of the ultraviolet ray or the visible ray. Therefore, the thin film was not detected by irradiation of the ultraviolet ray or the visible ray, and the thin film formed a latent image. The reflectance of gold was constant during the experiment. The surface tension of the thin film was 30 dyn/cm, and the surface tension on the gold film free of the film was about 60 dyn/cm.

The latent image was exposed to saturated steam, and drops having a diameter of about 0.1 mm adhered to the image. The contact angle of drop to gold was 90° on the film and about 25° on the uncoated gold surface. When the substrate was irradiated with visible light as a developing ray in the same manner as in Example 1, the latent image was visualized. In other words, the contact angle of drop was significantly different on the film and on the uncoated gold surface and the reflectance thus was dependent on the presence or absence of the film. In this method, a line having a width of 0.3 mm was recognized by the naked eye.

EXAMPLE 5

A mirror was prepared by depositing aluminum on a glass plate (10 cm×14 cm×3 mm in thickness). The mirror was washed in a conventional way. The mirror was subjected to the same treatment as in Example 1, and a thin film having a thickness of about 2.3 nm was formed as a latent image on the mirror. When the latent image was exposed to saturated steam, drops having a diameter of about 0.1 mm adhered to the image. The contact angle of drop to glass was 107° on the film and about 25° on the glass substrate. When the substrate was irradiated with helium-neon laser beam as a developing ray, the latent image was recognized by detecting reflected light in scanning the laser beam. In other words, the contact angle of drop was significantly different on the film and on the glass, and reflectance was dependent on the presence or absence of the film. In this method, a line having a width of 0.2 mm was recognized by the naked eye.

Similar latent images were formed on other substrates such as glass sputtered with titanium nitride, aluminum nitride or silicon carbide.

EXAMPLE 6

A thin film having a thickness of about 2.3 nm was formed as a latent image on the outer surface of a 150 ml wine glass in the same manner as in Example 1. When the latent image was exposed to saturated steam, drops having a diameter of about 0.1 mm adhered to the image. Water with ice was poured into the wine glass, and the wine glass was allowed to stand for 1 min in a humidity of 60%. Drops similarly adhered to the wine glass. The contact angle of drop to wine glass was 110° on the film and about 20° on the wine glass free of the film. When the wine glass was irradiated with visible light as a developing ray, the latent image was visualized. In this method, a line having a width of 0.3 mm was recognized by the naked eye.

Similar latent images were formed on other substrates such as a glass, a vase, a porcelain bowl, and a stainless cup.

EXAMPLE 7

Aluminum was deposited on part of a poly(vinyl chloride) card. FIG. 2(*a*) shows that aluminum 22 was deposited in an area of 2.5 cm×3 cm on 8.5 cm×5.3 cm card 21. As shown in FIG. 2(*b*), an identification photograph was printed on the deposited aluminum 22 by screen printing using ink. The printing divided the surface of the aluminum 22 into one part covered with ink and the other part free of ink. The part covered with ink corresponded to a black part of a photograph. The part free of ink corresponded to a white part of a photograph. The identification photograph was recorded as a black and white image.

The card was soaked in a solution of 1 wt. % heptadecafluorodecyltrichlorosilane ($CF_3$ $(CF_2)_7$ $(CH_2)_2SiCl_3$) in perfluoropentane at room temperature for 1h. Then, the card was washed with perfluoropentane. A thin film containing a fluoroalkyl was formed on the part of the card where aluminum 22 was exposed. The card was then washed with ethanol to remove the ink. The thickness of the thin film was 2.3 nm, and it was much thinner than the wavelength of ultraviolet ray or invisible ray. Therefore, the film formed as a latent image, because the thin film was not detected by such rays. FIG. 2(*c*) shows that the identification photograph did not appear on aluminum 22. When the inventor blew on the card, only the aluminum on which the thin film was formed was clouded white, and as shown in FIG. 2(*d*), the identification photograph appeared on aluminum 22. On stopping blowing on the card, the identification photograph became invisible again in a few seconds. The part of poly(vinyl chloride) in the card exhibited no change even when the inventor blew on the card.

As explained above, the latent image of the invention is easily formed by using a difference in surface tension between a substrate and a surface newly formed on the substrate, and the latent image is invisible to the naked eye under visible light. The latent image is not deteriorated over time or by irradiation of a developing ray. Consequently, the latent image is preserved semipermanently. When the latent image does not contact with a third substance, the image is not recognized. Therefore, the latent image is suitable for use requiring confidential information, such as identity cards. When the latent image is formed on articles, the appearance of the articles is not deteriorated. The latent image is visualized quickly to distinguish cards or articles. Therefore, cards or articles with the latent image are easy to use.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. A latent image comprising a first substance formed in a pattern corresponding to an image on a substrate of a second substance having a surface tension different from a surface tension of said first substance, the surface tension of the first substance being lower than that of the second substance, said first substance and said substrate having a difference of 0.1 to 100 nm in height from each other, the difference in surface tension being sufficient so that the latent image can be developed by irradiation with a developing ray after being contacted with steam.

2. The latent image according to claim 1, wherein said first substance forms a film having a thickness of 0.1 to 100 nm on said substrate.

3. The latent image according to claim 1, wherein said substrate is formed of at least one material selected from the group consisting of metal, glass, plastic, rock, ceramic and mineral.

4. The latent image according to claim 1, wherein said substrate has a transparent surface or a mirror surface.

5. The latent image according to claim 2, wherein said film is covalently bonded to a surface of said substrate via a covalent bond.

6. The latent image according to claim 2, wherein said first substance is an alkylpolysiloxane represented by Formula I

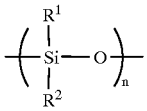

wherein $R^1$ is $C_{1-7}$ alkyl, $R^2$ is the same as or different from $R^1$ and is $C_{1-7}$ alkyl or $C_6$ aryl and n is an integer from 5 to 900.

7. The latent image according to claim 5, wherein said first substance is a silane compound bonded to a surface of said substrate via a siloxane bond (Si—O).

8. The latent image according to claim 5, wherein said first substance is a thiol compound.

9. The latent image according to claim 7, wherein said first substance is a compound having at least one group selected from the group consisting of alkyl groups and fluoroalkyl groups.

10. The latent image according to claim 7, wherein said first substance is a compound having at least one group selected from the group consisting of alkyl groups and fluoroalkyl groups.

11. An article having a latent image, the latent image comprising a first substance in a pattern corresponding to an image, formed on a substrate of a second substance having a surface tension different from a surface tension of said first substance, the surface tension of the first substance being lower than that of the second substance, said first substance and said substance having a difference of 0.1 to 100 mm in height from each other, the difference in surface tension being sufficient so that the latent image can be developed by irradiation with a developing ray after being contacted with steam.

12. The article according to claim 11, wherein said first substance forms a film having a thickness of 0.1 to 100 mm on said substrate.

13. The article according to claim 11, wherein said substrate is formed of at least one material selected from the group consisting of metal, glass, plastic, rock, ceramic and mineral.

14. The article according to claim 4, wherein said article is a plastic product partly coated with metal.

15. The article according to claim 11, wherein said article is a card.

16. The article according to claim 11, wherein said article is one selected from the group consisting of a credit card, an identification card, a license, a certificate, a membership card and a cash card.

17. The article according to claim 11, wherein said article is one selected from the group consisting of a metallic container, a glass container, a ceramic container and a porcelain container.

* * * * *